US009188123B2

(12) United States Patent
Hubenschmidt et al.

(10) Patent No.: US 9,188,123 B2
(45) **Date of Patent: *Nov. 17, 2015**

(54) PUMP ASSEMBLY

(75) Inventors: Joe Hubenschmidt, Sugar Land, TX (US); Brian Ochoa, Hanover (DE); Philippe Gambier, La Defence (FR); Aude Faugere, Houston, TX (US); Christopher Shen, Houston, TX (US); Tze Wei Chua, Tulsa, OK (US); Walter Taylor, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 691 days.

This patent is subject to a terminal disclaimer.

(21) Appl. No.: 13/276,250

(22) Filed: Oct. 18, 2011

(65) Prior Publication Data

US 2012/0148430 A1 Jun. 14, 2012

Related U.S. Application Data

(63) Continuation-in-part of application No. 12/840,545, filed on Jul. 21, 2010, now Pat. No. 8,601,687.

(60) Provisional application No. 61/394,079, filed on Oct. 18, 2010.

(51) Int. Cl.
*F04B 35/00* (2006.01)
*F04B 53/12* (2006.01)
(Continued)

(52) U.S. Cl.
CPC ..... *F04B 53/12* (2013.01); *F04B 53/007* (2013.01); *F04B 53/14* (2013.01); *F04B 53/162* (2013.01); *Y10T 29/49236* (2015.01)

(58) Field of Classification Search
CPC ..... F04B 53/007; F04B 53/12; F04B 53/14; F04B 53/162; Y10T 29/49236
USPC ..... 417/360, 521, 571, 273; 137/512; 248/639; 29/888.02, 888.042, 888.044; 403/230, 292, 296
See application file for complete search history.

(56) References Cited

U.S. PATENT DOCUMENTS 5,094,034 A * 3/1992 Freeman ..... 49/501
6,419,459 B1 * 7/2002 Sibbing ..... 417/360
(Continued)

FOREIGN PATENT DOCUMENTS

WO 2011018732 A2 2/2011
WO 2011027273 A2 3/2011
(Continued)

OTHER PUBLICATIONS

Cementing HT-400 Pump, Halliburton Brochure, H04798, Apr. 2006.
(Continued)

*Primary Examiner* — Charles Freay
*Assistant Examiner* — Patrick Hamo
(74) *Attorney, Agent, or Firm* — Michael L. Flynn; Rachel E. Greene; Tim Curington

(57) ABSTRACT

A pump assembly having a power end and a fluid end, wherein the fluid end includes a plurality of pump bodies connected side by side between opposing end plates with a plurality of fasteners tightened to compress the pump bodies between the end plates. The power end and at least one of the plurality of pump bodies being connected together by a tie rod having a rod portion and a sleeve portion, wherein the sleeve portion surrounds the rod portion and abuts the power end at an end and at least one of the pump bodies of the fluid end at an opposite end.

14 Claims, 6 Drawing Sheets

(51) Int. Cl.

| | |
|---|---|
| ***F04B 53/00*** | (2006.01) |
| ***F04B 53/14*** | (2006.01) |
| ***F04B 53/16*** | (2006.01) |

(56) References Cited

U.S. PATENT DOCUMENTS

| | | | | |
|---|---|---|---|---|
| 6,910,871 | B1 | 6/2005 | Blume | |
| 7,484,452 | B2 * | 2/2009 | Baxter et al. | 92/169.1 |
| 2003/0235508 | A1 | 12/2003 | Vicars | |
| 2009/0092510 | A1 | 4/2009 | Williams et al. | |
| 2011/0289753 | A1 | 12/2011 | Leugemors et al. | |

FOREIGN PATENT DOCUMENTS

| | | | |
|---|---|---|---|
| WO | 2011027274 | A2 | 3/2011 |
| WO | 2011095935 | A2 | 8/2011 |

OTHER PUBLICATIONS

MSI X-treme Service Brochure.

* cited by examiner

PUMP ASSEMBLY

CROSS-REFERENCE TO RELATED APPLICATIONS

This application is a continuation-in-part of U.S. patent application Ser. No. 12/840,545, filed on Jul. 21, 2010, and entitled PUMP BODY, which claims priority to U.S. Provisional application No. 61/233,709, filed on Aug. 13, 2009, and entitled PUMP BODY; this application also claims benefit of priority to U.S. Provisional patent application No. 61/394,079, filed Oct. 18, 2010, and entitled PUMP ASSEMBLY WITH IMPROVED TIE ROD; the entire contents of which are incorporated herein by reference.

TECHNICAL FIELD

The present disclosure is related in general to wellsite surface equipment such as fracturing pumps and the like.

BACKGROUND

The statements in this section merely provide background information related to the present disclosure and may not constitute prior art.

Reciprocating pumps such as triplex pumps and quintuplex pumps are generally used to pump high pressure fracturing fluids downhole. An example of a triplex or quintuplex pump is disclosed in commonly assigned PCT Application No. PCT/IB2010/053868, the entire contents of which are hereby incorporated by reference into the current disclosure. Typically, the pumps that are used for this purpose have plunger sizes varying from about 7 cm (2.75 in.) to about 16.5 cm (6.5 in.) in diameter and may operate at pressures up to 144.8 MPa (21,000 psi). In one case, the outer diameter of the plunger is about 9.5 cm (3.75 in) and the reciprocating pump is a triplex pump.

These pumps typically have two sections: (a) a power end, the motor assembly that drives the pump plungers (the driveline and transmission are parts of the power end); and (b) a fluid end, the pump container that holds and discharges pressurized fluid.

In triplex pumps, the fluid end has three fluid cylinders. For the purpose of this document, the middle of these three cylinders is referred to as the central cylinder, and the remaining two cylinders are referred to as side cylinders. A fluid end may comprise a single block having cylinders bored therein, known in the art as a monoblock fluid end. Similarly, a quintuplex pump has five fluid cylinders, including a middle cylinder and four side cylinders.

The pumping cycle of the fluid end is composed of two stages: (a) a suction cycle: During this part of the cycle a piston moves outward in a packing bore, thereby lowering the fluid pressure in the fluid end. As the fluid pressure becomes lower than the pressure of the fluid in a suction pipe (typically 2-3 times the atmospheric pressure, approximately 0.28 MPa (40 psi)), the suction valve opens and the fluid end is filled with pumping fluid; and (b) a discharge cycle: During this cycle, the plunger moves forward in the packing bore, thereby progressively increasing the fluid pressure in the pump and closing the suction valve. At a fluid pressure slightly higher than the line pressure (which can range from as low as 13.8 MPa (2,000 psi) to as high as 144.8 MPa (21,000 psi) the discharge valve opens, and the high pressure fluid flows through the discharge pipe. In some cases, the pump is operated at 12,000 psi. In some other cases, the pump is operated at 15,000 psi. In some further cases, the pump is operated at 20,000 psi.

In assembling and operating these pumps at such harsh conditions, zones of weaknesses have been identified which present a high potential for failure and injury. One example zone includes the tie rods used to connect the power and the fluid end of the pumps, and more particularly the threads at each end of the tie rods. As a precaution, tie rods that are generally used in the industry need to be periodically inspected and replaced in an effort to prevent the tie rod from becoming defective.

It is therefore desirable to provide an improved tie rod and pump equipment to increase efficiency, flexibility, reliability, and maintainability.

SUMMARY OF THE DISCLOSURE

According to an aspect of the present disclosure, one or more embodiments relates to a pump assembly comprising a power end, a fluid end, and a tie rod. The fluid end comprises a plurality of pump bodies connected side by side between opposing end plates with a plurality of fasteners tightened to compress the pump bodies between the end plates. The tie rod for connecting the power end and at least one of the pump bodies of the fluid end comprises a rod portion and a sleeve portion. The sleeve portion surrounds the rod portion and abuts the power end at an end and at least one of the pump bodies of the fluid end at an opposite end.

According to another aspect of the present disclosure, one or more embodiments relate to a method comprising connecting a power end and a fluid end having a plurality of pump bodies side by side between opposing end plates with a plurality of fasteners to form a pump assembly. The method includes connecting the power end and at least one of the pump bodies of the fluid end with a tie rod, wherein the tie rod comprises a rod portion and a sleeve portion. The sleeve portion surrounds the rod portion and abuts the power end at an end and at least one of the pump bodies of the fluid end at an opposite end.

These together with other aspects, features, and advantages of the present disclosure, along with the various features of novelty, which characterize the invention, are pointed out with particularity in the claims annexed to and forming a part of this disclosure. The above aspects and advantages are neither exhaustive nor individually or jointly critical to the spirit or practice of the disclosure. Other aspects, features, and advantages of the present disclosure will become readily apparent to those skilled in the art from the following detailed description in combination with the accompanying drawings. Accordingly, the drawings and description are to be regarded as illustrative in nature, and not restrictive.

BRIEF DESCRIPTION OF THE SEVERAL VIEWS OF THE DRAWINGS

To assist those of ordinary skill in the relevant art in making and using the subject matter hereof, reference is made to the appended drawings, which are not intended to be drawn to scale, and in which like reference numerals are intended to refer to similar elements for consistency. For purposes of clarity, not every component may be labeled in every drawing.

DETAILED DESCRIPTION

Specific embodiments of the present disclosure will now be described in detail with reference to the accompanying drawings. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

The terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Figure 6:
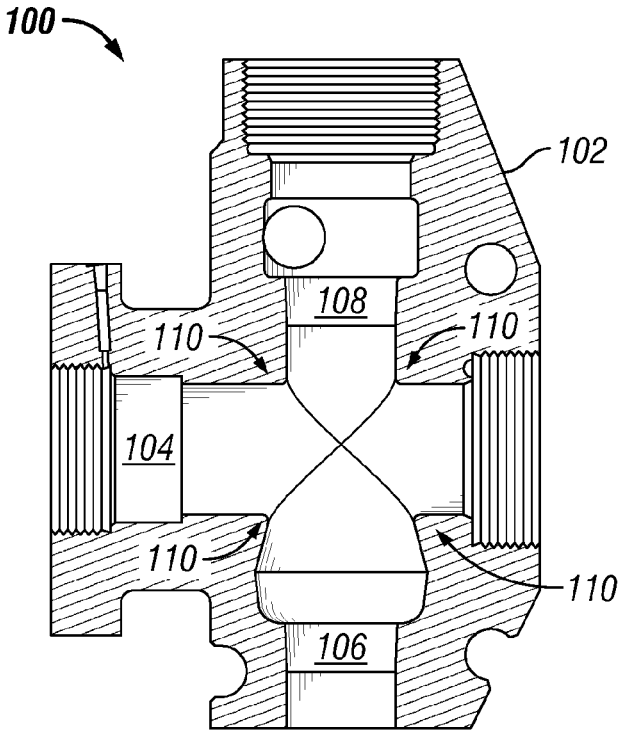
FIG. 6 depicts a side sectional view of the pump body of FIG. 5 according to an embodiment of the disclosure.
Figure 7:
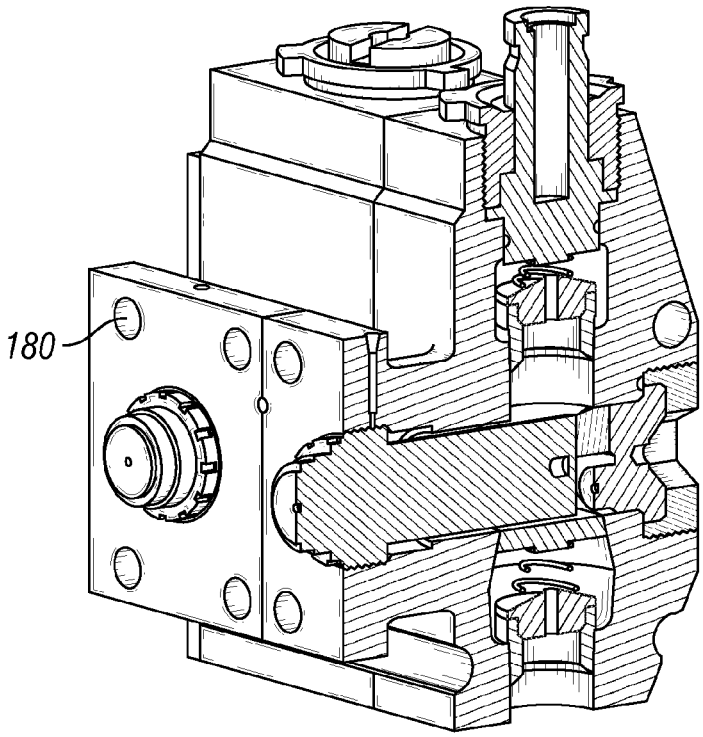
FIG. 7 depicts a perspective view, partially cut away, of the pump fluid end assembly of FIGS. 1-4 according to an embodiment of the disclosure.
Figure 8:
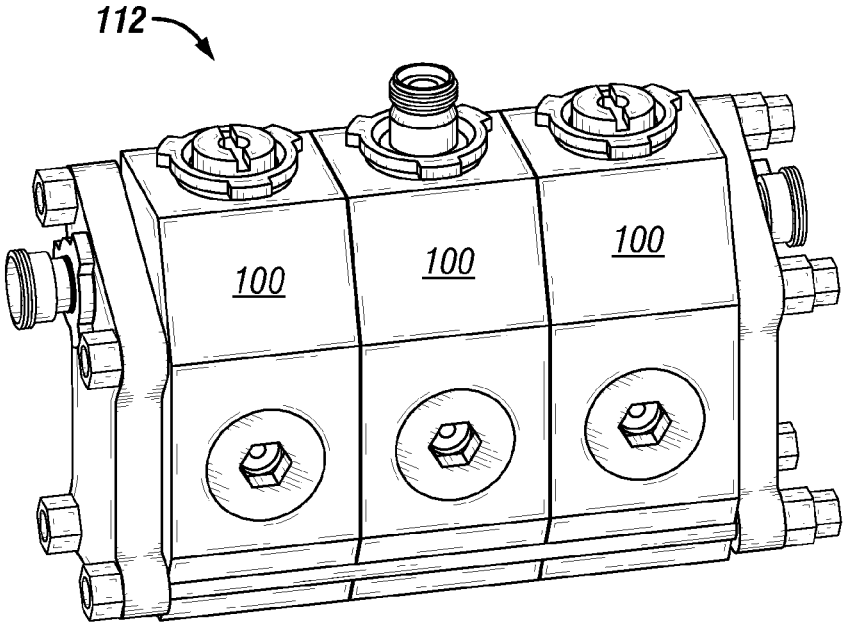
FIG. 8 depicts another fluid end perspective view of the triplex pump fluid end assembly of FIGS. 1-3 according to an embodiment of the disclosure.
Figure 9:
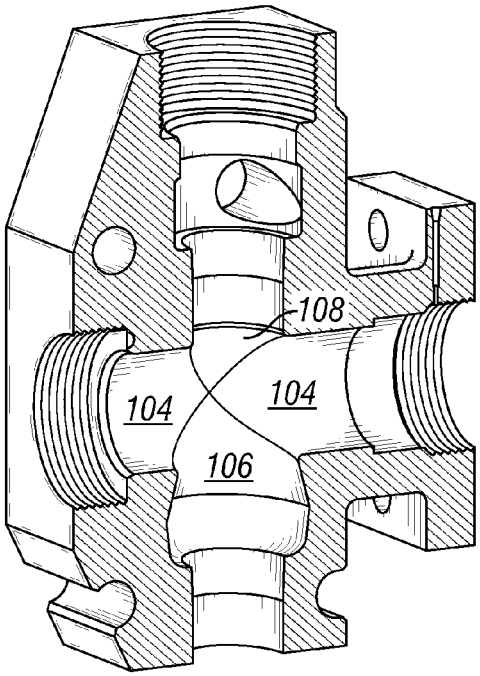
FIG. 9 depicts a perspective view of the bore configuration of the pump body of FIGS. 5-6 according to an embodiment of the disclosure.

Referring now to all of the Figures, there is disclosed a pump body portion or fluid end, indicated generally at 100. The pump body portion 100 comprises a body 102 that defines an internal passage or piston bore 104 for a receiving a pump plunger (best seen in FIG. 7). The pump body portion 100 may further define an inlet port 106 and an outlet port 108. The inlet port 106 and the outlet port 108 may be substantially perpendicular to the piston bore 104, forming a conventional crossbore body portion 100, best seen in FIG. 6. The piston bore 104 may comprise a pair of bores, such as that shown in FIG. 9. The intersection of the piston bore 104 and the inlet and outlet ports 106 and 108 defines at least one area 110 of stress concentration that may be a concern for material fatigue failure. In addition to the stress concentration, the area 110 is subject to operational pressure of the pump discussed hereinabove, which may further increase its fatigue failure risk. Those skilled in the art will appreciate that the pump body portion 100 may comprise bores formed in other configurations such as a T-shape, Y-shape, in-line, or other configurations.

Figure 1:
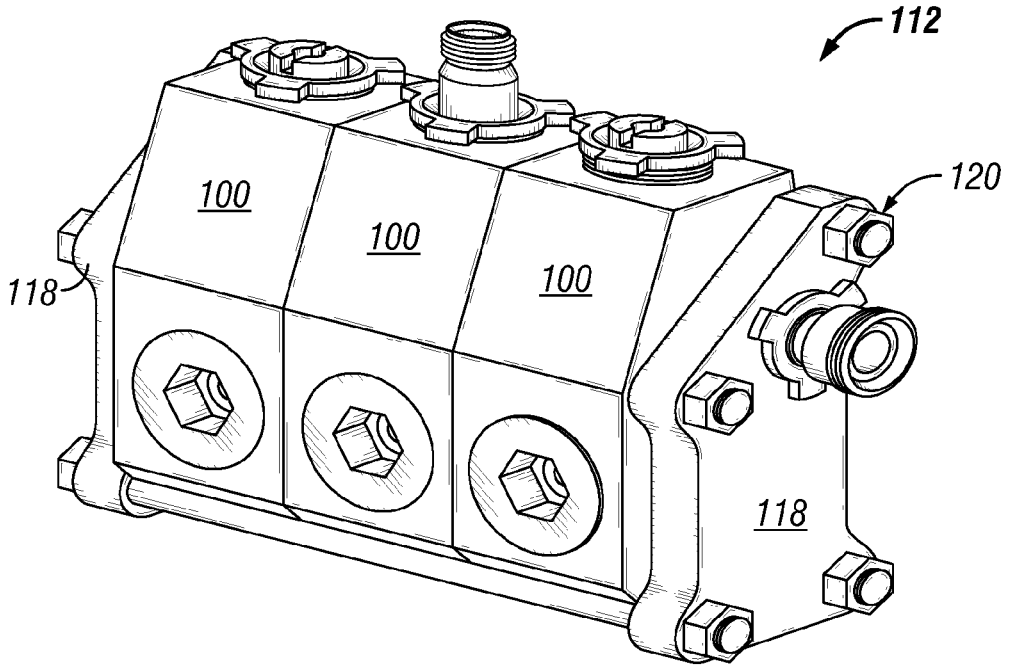
FIG. 1 depicts a fluid end perspective view of a triplex pump fluid end assembly according to an embodiment of the disclosure.
Figure 2:
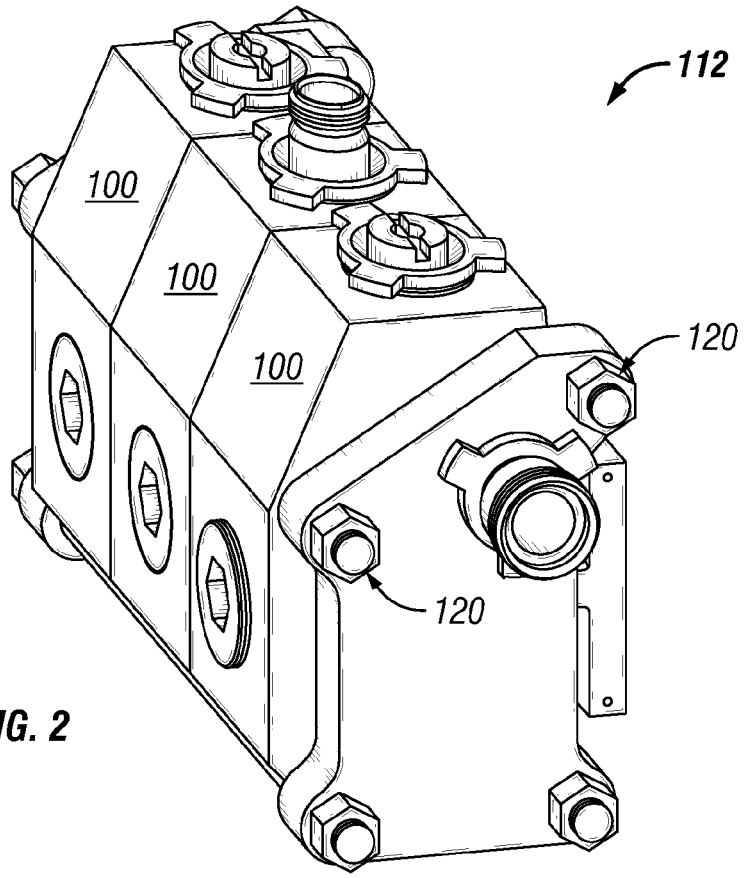
FIG. 2 depicts another fluid end perspective view of the triplex pump fluid end assembly of FIG. 1 according to an embodiment of the disclosure.

According to some embodiments, three pump body portions 100 are arranged to form a triplex pump assembly 112, best seen in FIG. 1. Those skilled in the art will appreciate that the pump body portions 100 may also be arranged in other configurations, such as a quintuplex pump assembly comprising five pump body portions 100 or the like.

Figure 5:
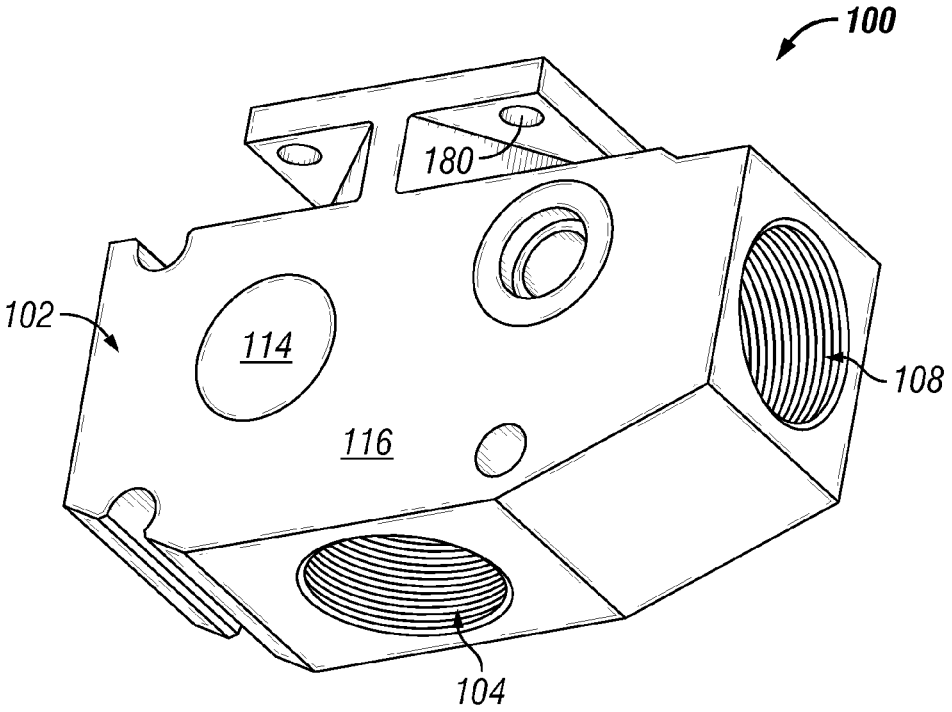
FIG. 5 depicts a perspective view of one of the pump body portions of the triplex pump fluid end assembly of FIGS. 1-4 according to an embodiment of the disclosure.

A raised surface 114 extends from an exterior surface 116 of the pump body portions 100, best seen in FIG. 5. The raised surface 114 may extend a predetermined distance from the exterior surface 116 and may define a predetermined area on the exterior surface 116. In one embodiment, at least one pump body comprises a raised surface on an opposite exterior side surface of the pump body. In another embodiment, each pump body comprises a raised surface on the opposite exterior side surface of the pump body. While illustrated as circular in shape in FIG. 5, the raised surface 114 may be formed in any suitable shape.

Figure 10:
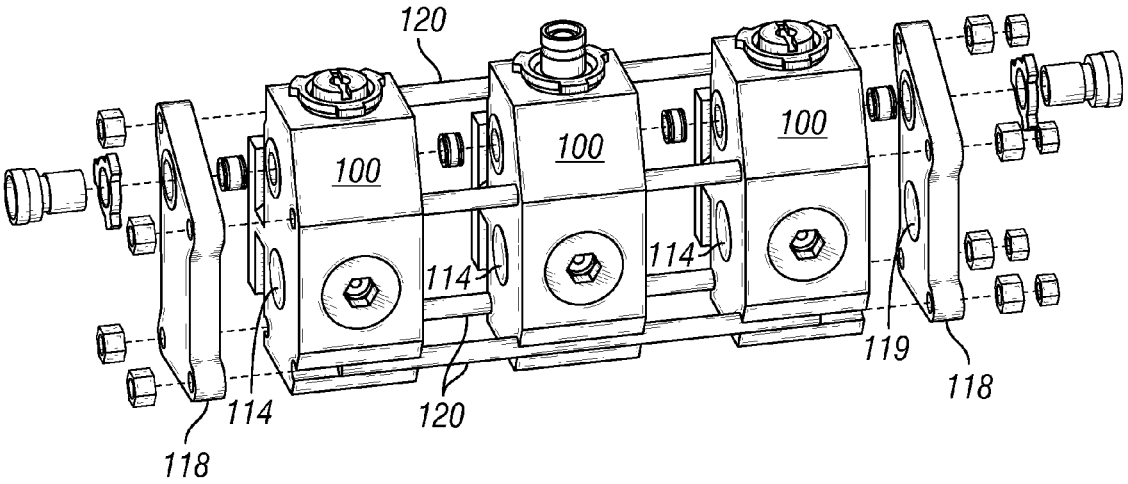
FIG. 10 depicts an exploded view of the triplex pump fluid end assembly of FIGS. 1-3 according to an embodiment of the disclosure.

An end plate 118 is fitted on each of the outer or side pump body portions 100 to aid in assembling the body portions 100 into the pump fluid end assembly, such as the triplex pump fluid end assembly 112 shown in FIG. 1. The end plates 118 are utilized, in conjunction with fasteners 120, to assemble the pump body portions 100 to form the pump fluid end assembly 112. The end plates 118 may further comprise a raised surface 119, best seen in FIG. 10, similar to the surface 114 on the pump body portions 100 for engaging with the raised surfaces 114 of the pump body portions 100 during assembly.

The bores 104, 106, and 108 of the pump body portions 100 may define substantially similar internal geometry as prior art monoblock fluid ends to provide similar volumetric performance. When the pump fluid end assembly 112 is assembled, the three pump body portions 100 are assembled together using, for example, four large fasteners 120 and the end plates 118 on opposing ends of the pump body portions 100. At least one of the fasteners 120 may extend through the pump body portions 100, while the other of the fasteners 120 may be external of the pump body portions 100.

As the fasteners 120 are torqued (via nuts or the like) to assemble the pump fluid end assembly 112, the raised surfaces 114 on the pump body portions 100 and raised surfaces 119 on the end plates 118 engage with one another to provide a pre-compressive force to the areas 110 of the pump body portions 100 adjacent the intersection of the bores 104, 106, and 108. The pre-compressive force is believed to counteract the potential deformation of the areas 110 due to the operational pressure encountered by the bores 104, 106, and 108. By counteracting the potential deformation due to operational pressure, stress on the areas 110 of the pump body portions 100 is reduced, thereby increasing the overall life of the pump bodies 100 by reducing the likelihood of fatigue failures. Those skilled in the art will appreciate that the torque of the fasteners 120 and the raised surfaces 114 and 119 cooperate to provide the pre-compressive force on the areas 110.

Due to the substantially identical profiles of the plurality of pump body portions 100, the pump body portions 100 may be advantageously interchanged between the middle and side portions 100 of the assembly 112, providing advantages in assembly, disassembly, and maintenance, as will be appreciated by those skilled in the art. In operation, if one of the pump bodies 100 of the assembly 112 fails, only the failed one of the pump bodies 100 need be replaced, reducing the potential overall downtime of a pump assembly 112 and its associated monetary impact. The pump body portions 100 are smaller than a typical monoblock fluid end having a single body with a plurality of cylinder bores machined therein and therefore provides greater ease of manufacturability due to the reduced size of forging, castings, etc.

Figure 3:
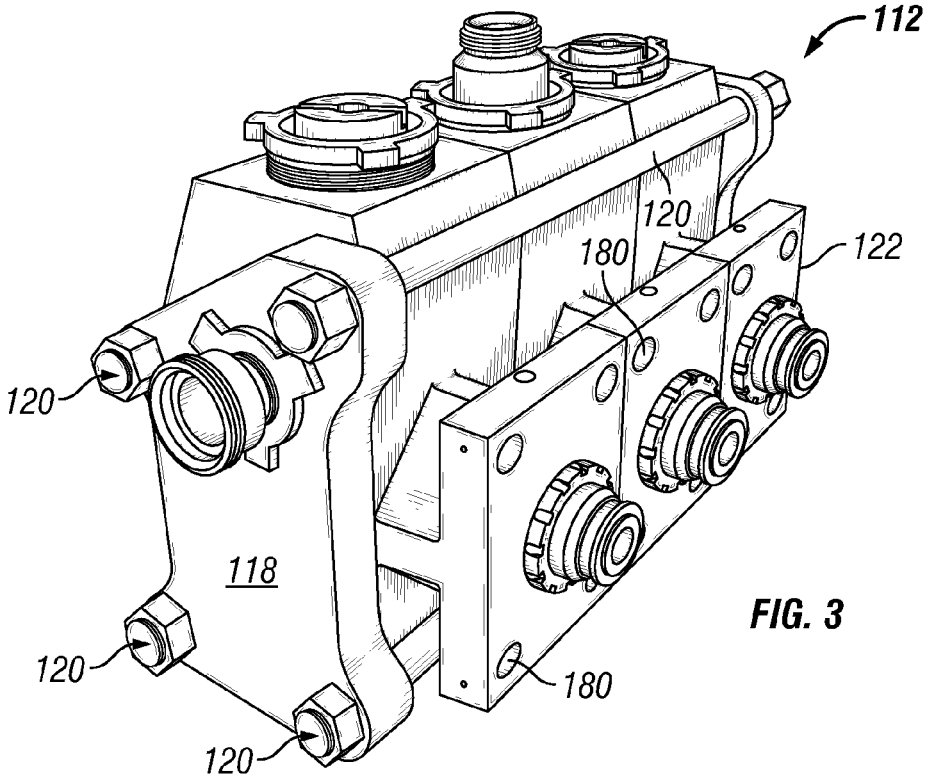
FIG. 3 depicts a power end perspective view of the triplex pump fluid end assembly of FIGS. 1-2 according to an embodiment of the disclosure.
Figure 4:
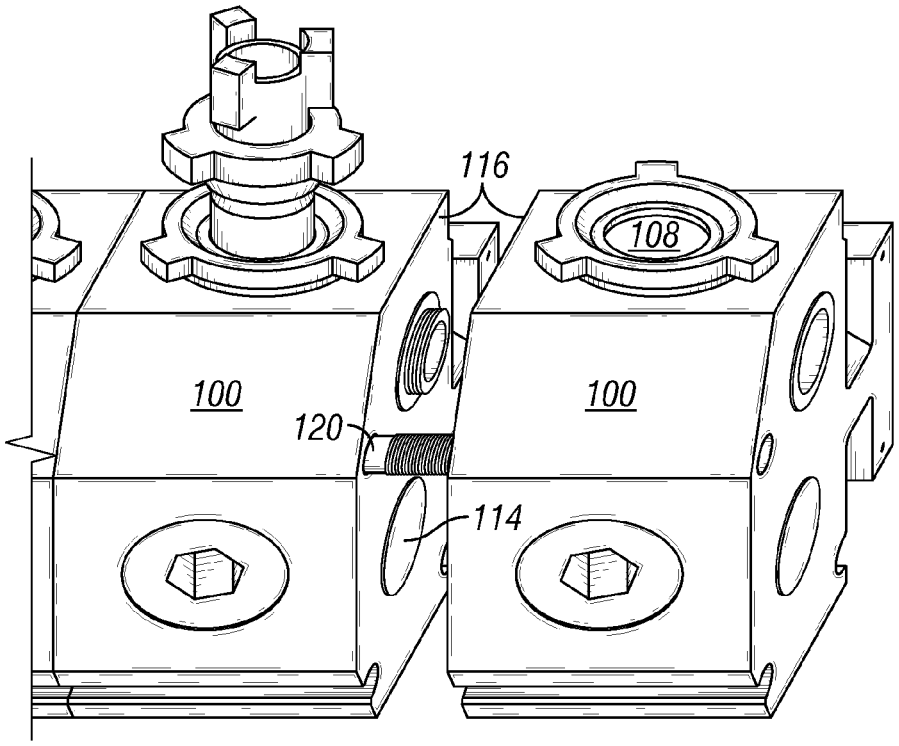
FIG. 4 depicts a partially disassembled view of the triplex pump fluid end assembly of FIGS. 1-3 according to an embodiment of the disclosure.

An attachment flange 122, best seen in FIG. 3, may extend from the pump body portion 100 for guiding and attaching a power end 150 (see FIG. 12) to the plungers (see FIG. 7) and ultimately to a prime mover (not shown), such as a diesel engine or the like, as will be appreciated by those skilled in the art.

Figure 11:
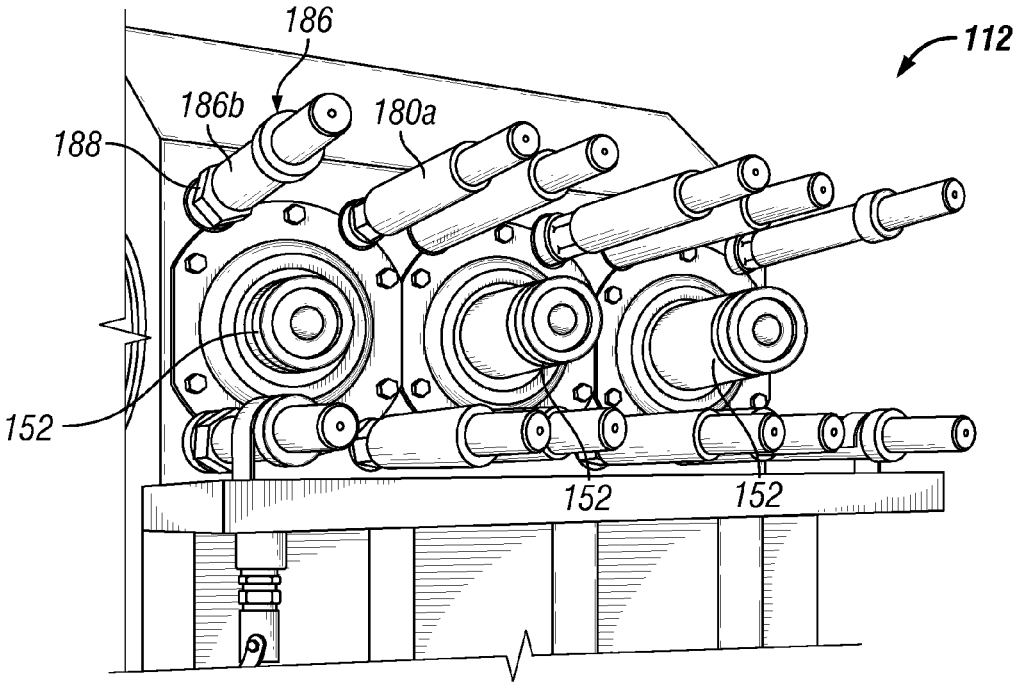
FIG. 11 depicts a power end perspective view of the triplex pump fluid end assembly of FIGS. 1-3 having a plurality of tie rods attached thereto according to an embodiment of the disclosure.

The attachment flange 122 may further comprise a plurality of holes 180 and have a plurality of tie rods 186 attached thereto, as shown in FIG. 11. According to at least one embodiment of the present disclosure, the tie rods 186 are substantially cylindrical in shape, comprising a body portion and at least one threaded portion 183 (see FIG. 12) at an end that is adapted for matingly engaging the hole 180. The body portion can be substantially uniform in diameter along the length of the body, as shown as rod 186*a* in FIG. 11. In another embodiment, at least one portion of the body of the tie rod is enlarged to form a stepped ring or shouldered portion 188, as shown as rod 186*b* in FIG. 11. In some cases, the stepped ring 188 is formed towards the end of the rod 186*b* that will be attached to the attachment flange 122.

During operation, the threads at each end of the tie rods 186 are susceptible to fatigue. The threads at the power end of the triplex pump assembly 112 are particularly vulnerable. When the threads become defective, the tie rod 186 can no longer hold the pump assembly 112 tightly together. As a result, pump failure and injury/casualty to pump operators may occur.

In at least one embodiment of the present disclosure, a tie rod 186 is provided which comprises at least two portions: a sleeve portion 182 and a rod portion 184. In one embodiment, the sleeve portion 182 is substantially cylindrical in shape, with an internal hollow space to accommodate the rod portion 184. The rod portion 184 can be substantially uniform in diameter. Alternatively, the rod portion 184 may have at least one stepped ring 188 as shown in FIG. 11 of the disclosure. In some embodiments, the outer diameter of the rod portion 184 is smaller than the inner diameter of the sleeve so that the rod portion 184 can slide in and out of the sleeve portion 182 during assembly. Alternatively, the outer diameter of the rod portion 184 can be substantially the same as the inner diameter of the sleeve portion 182 so that substantial amount of friction can exist between the outer surface of the rod portion 184 and the inner surface of the sleeve portion 182. In some embodiments, the sleeve portion 182 is a monolithic product; in some other embodiments, the sleeve portion 182 comprises a plurality of sub-components, such as two half cylindrical walls, etc., which can be attached together during the assembly to surround the rod portion 184 of the tie rod 186.

As shown in FIG. 11, a pump assembly 112 constructed in accordance with an embodiment of the present disclosure may include any number of tie rods 186 for connecting the power end 150 and the fluid end body portions 100. For example, twelve tie rods 186 are shown for joining the fluid end body portions 100 and the power end 150. Connection with the tie rods 186 may be made by machining complementary threaded bores into the attachment flange 122 or the power end 150 to be threadingly engageable with the threaded portion 183 of the tie rod 186. Alternatively, connection between the fluid end body portions 100 and the power end 150 may be made by tightening a nut 190, such as a heavy hex nut or the like, on the tie rod 186.

Figure 12:
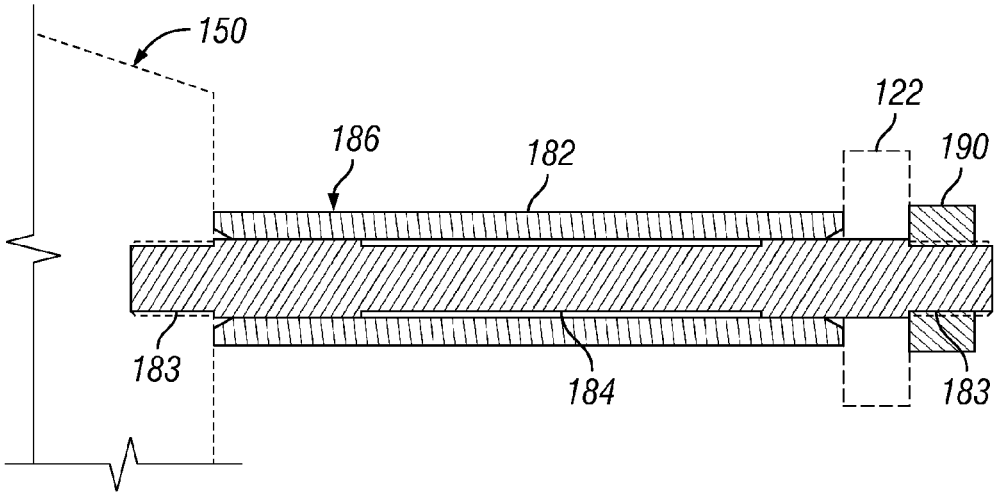
FIG. 12 depicts a cross-sectional view of a tie rod according to an embodiment of the disclosure.

Referring now to FIG. 12, a cross-sectional view of a tie rod 186 is shown according to one embodiment of the current disclosure. The tie rod 186 comprises a rod portion 184 and a sleeve portion 182. The sleeve portion 182 has a length that is substantially equal to the distance between the fluid end attachment flange 122 and the power end 150. In one implementation of assembly, the sleeve portion 182 functions as a spacer between the power end 150 and the fluid end attachment flange 122, abutting against the fluid end attachment flange 122 and the power end 150. Therefore, the magnitude of fluctuation of the power end 150 and/or the fluid end body portions 100 can be partially transferred to the sleeve portions 182. The load on the rod portion 184 is substantially reduced and the stress on the threads is decreased. As a result, the threads of the rod portion 184 are protected and the life of the tie rod 186 is prolonged.

The preceding description has been presented with reference to some embodiments. Persons skilled in the art and technology to which this disclosure pertains will appreciate that alterations and changes in the described structures and methods of operation can be practiced without meaningfully departing from the principle, and scope of this disclosure. For example, even though the Figures of the current disclosure illustrate a sleeve portion and a rod portion have a cross-sectional profile of a ring and a circle, respectively, other profiles and shapes such as triangular, square, pentagon, hexagon, and so on are also possible. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A pump assembly, comprising:

a power end;

a fluid end comprising a plurality of pump bodies connected side by side between opposing end plates with a plurality of fasteners tightened to assemble and to compress the pump bodies between the end plates; and a tie rod connecting the power end and at least one of the pump bodies of the fluid end;

wherein the tie rod comprises a rod portion and a sleeve portion, said sleeve portion surrounds the rod portion and abuts the power end at an end and at least one of the pump bodies of the fluid end at an opposite end.

2. The pump assembly of claim 1 wherein at least one of the pump bodies of the fluid end further comprises a flange, and the sleeve portion of the tie rod abuts the flange.

3. The pump assembly of claim 1 wherein the rod portion of the tie rod is substantially uniform in diameter.

4. The pump assembly of claim 1 wherein the rod portion of the tie rod has at least one stepped ring.

5. The pump assembly of claim 1 wherein the outer diameter of the rod portion is smaller than the inner diameter of the sleeve portion.

6. The pump assembly of claim 1 wherein the outer diameter of the rod portion is substantially the same as the inner diameter of the sleeve portion.

7. A pump assembly, comprising:

a power end;

a fluid end comprising a plurality of pump bodies connected side by side between opposing end plates with a plurality of fasteners tightened to compress the pump bodies between the end plates; and a tie rod connecting the power end and at least one of the pump bodies of the fluid end;

wherein the tie rod comprises a rod portion and a sleeve portion, said sleeve portion surrounds the rod portion and abuts the power end at an end and at least one of the pump bodies of the fluid end at an opposite end;

wherein each pump body comprises a piston bore, an inlet bore, an outlet bore;

wherein at least one pump body comprises a raised surface on an exterior side surface of the pump body; and wherein the raised surface engages with an adjacent end plate or an adjacent pump body to apply a pre-compressive force at the raised surface on the pump body.

8. A method, comprising;

providing a power end;

assembling a fluid end comprising a plurality of pump bodies connected side by side between opposing end plates by tightening a plurality of fasteners to compress the pump bodies between the end plates; and connecting the assembled power end and at least one of the pump bodies of the fluid end with a tie rod;

wherein the tie rod comprises a rod portion and a sleeve portion, said sleeve portion surrounds the rod portion and abuts the power end at an end and at least one of the pump bodies of the fluid end at an opposite end.

9. The method of claim 8, wherein at least one of the pump bodies of the fluid end further comprises a flange, and the sleeve portion of the tie rod abuts the flange.

10. The method of claim 8, wherein the rod portion of the tie rod is substantially uniform in diameter.

11. The method of claim 8, wherein the rod portion of the tie rod has at least one stepped ring.

12. The method of claim 8, wherein the outer diameter of the rod portion is smaller than the inner diameter of the sleeve portion.

13. The method of claim 8, wherein the outer diameter of the rod portion is substantially the same as the inner diameter of the sleeve portion.

14. A method, comprising:

providing a power end;

providing a fluid end comprising a plurality of pump bodies connected side by side between opposing end plates with a plurality of fasteners tightened to compress the pump bodies between the end plates; and connecting the power end and at least one of the pump bodies of the fluid end with a tie rod;

wherein the tie rod comprises a rod portion and a sleeve portion, said sleeve portion surrounds the rod portion and abuts the power end at an end and at least one of the pump bodies of the fluid end at an opposite end;

wherein each pump body comprises a raised surface on an exterior side surface of the pump body.

* * * * *